US011786023B2

(12) United States Patent
Maria

(10) Patent No.: US 11,786,023 B2
(45) Date of Patent: Oct. 17, 2023

(54) PORTABLE TENNIS EQUIPMENT BAG

(71) Applicant: Charles Edouard Maria, Palm Beach Gardens, FL (US)

(72) Inventor: Charles Edouard Maria, Palm Beach Gardens, FL (US)

( * ) Notice: Subject to any disclaimer, the term of this patent is extended or adjusted under 35 U.S.C. 154(b) by 0 days.

(21) Appl. No.: 17/892,689

(22) Filed: Aug. 22, 2022

(65) Prior Publication Data

US 2023/0053894 A1 Feb. 23, 2023

Related U.S. Application Data

(60) Provisional application No. 63/235,252, filed on Aug. 20, 2021.

(51) Int. Cl.

| | |
|---|---|
| ***A45C 9/00*** | (2006.01) |
| ***A45C 13/02*** | (2006.01) |
| ***A45C 13/26*** | (2006.01) |
| ***A45C 5/14*** | (2006.01) |
| ***A45C 7/00*** | (2006.01) |
| ***A45C 13/04*** | (2006.01) |
| *A45C 3/00* | (2006.01) |

(52) U.S. Cl.

CPC ..... *A45C 9/00* (2013.01); *A45C 5/14* (2013.01); *A45C 7/0022* (2013.01); *A45C 13/02* (2013.01); *A45C 13/04* (2013.01); *A45C 13/262* (2013.01); *A45C 2003/007* (2013.01); *A45C 2013/267* (2013.01)

(58) Field of Classification Search

CPC ..... A45C 5/14; A45C 5/146; A45C 13/262; A45C 9/00; A45C 13/385; A45C 13/02; A45C 13/28; A45C 13/04; A45C 3/02; A45C 15/00; A45C 2013/267; A45C 2003/007; A45C 7/0022

USPC ..... 190/18 A, 11, 1, 115, 18 R; 206/315.9

See application file for complete search history.

(56) References Cited

U.S. PATENT DOCUMENTS

| | | | | |
|---|---|---|---|---|
| 6,230,916 | B1 | 5/2001 | Bradford | |
| 6,929,268 | B1 * | 8/2005 | Owens | B62B 3/008 280/37 |
| 7,866,719 | B1 | 1/2011 | Lucca | |
| 7,870,937 | B1 | 1/2011 | Arnao | |
| 8,181,760 | B2 * | 5/2012 | Trieu | A45C 11/38 396/419 |
| 8,333,271 | B2 * | 12/2012 | Gibson | A47B 3/02 190/18 R |
| 9,295,311 | B2 | 3/2016 | Gadzinkski et al. | |
| 10,092,093 | B2 | 10/2018 | Campbell, Jr. et al. | |

(Continued)

*Primary Examiner* — King M Chu

(74) *Attorney, Agent, or Firm* — The Concept Law Group, PA; Scott D. Smiley; Scott M. Garrett

(57) ABSTRACT

A portable tennis equipment bag includes a bag body that has an internal frame that supports the shape of the body and which further provides support for a plurality of extendible legs that can extend from the bottom of the bag. The extendible legs can also collapse inside of the bag body. Each of the extendible legs can be attached, at their lower ends, to an lower shelf member at the bottom of the body of the bag, outside of the body of the bag. As a result, when the extendible legs are extended, the lower shelf portion is separated from the body of the bag and sits beneath the body of the bag, attached to the legs. Rolling mechanisms can be provided at the bottom of the lower shelf portion to allow the bag to be moved about across a surface such as a tennis court.

17 Claims, 14 Drawing Sheets

(56) References Cited

U.S. PATENT DOCUMENTS

| | | | | |
|---|---|---|---|---|
| 2007/0261975 | A1* | 11/2007 | Rabinoff | A45C 13/03 206/287.1 |
| 2010/0187062 | A1* | 7/2010 | Sweeney | A45C 13/262 190/115 |
| 2015/0342316 | A1* | 12/2015 | Tong | A45C 5/03 190/109 |
| 2017/0245608 | A1* | 8/2017 | King | A45C 13/262 |
| 2018/0116353 | A1* | 5/2018 | Howell | A45C 9/00 |

* cited by examiner

PORTABLE TENNIS EQUIPMENT BAG

CROSS REFERENCE

This application claims priority to U.S. provisional application No. 63/235,252, filed Aug. 20, 2021, the entirety of which is hereby incorporated by reference.

FIELD OF THE INVENTION

The present invention relates generally to athletic equipment bags, and, more particularly, relates to a portable tennis equipment bag that includes extendible legs for standing the bag up when in use, and which collapse for carrying and transport.

BACKGROUND OF THE INVENTION

In the game of tennis, and more particularly during training for tennis, players strike a significant amount of tennis balls in a session, resulting in tennis balls being scattered across one or more tennis courts. This requires an individual to gather each tennis ball individually for storage in a centralized location, requiring time and energy. Hoppers and other ball collector mechanisms have been implemented in order to facilitate easier accumulation and storage of tennis balls. However, these mechanisms tend to be bulkier in size, limiting their portability.

Furthermore, tennis players prefer to store their equipment in athletic bags in order to protect the equipment, and to be able to carry their equipment with them. A major drawback to athletic bags is that they are limited in their ability to store certain sized tennis rackets in addition to other equipment necessary to play. Therefore, a need exists for a new and improved athletic equipment receptacle that circumvents the aforementioned issues.

SUMMARY OF THE DISCLOSURE

In some embodiments, the disclosure provides an athletic receptacle including a plurality of walls configured to cooperate to define an interior space; a frame associated with the interior space; a plurality of telescoping legs configured to be affixed to the frame; and a plurality of rolling mechanisms configured to be affixed to the plurality of telescoping legs.

In accordance with some embodiments of the inventive disclosure, there is provided an athletic receptacle that includes a body having a plurality of walls which define an interior space, a frame disposed in the interior space, a plurality of telescoping legs configured to be affixed to the frame, a plurality of rolling mechanisms configured to be affixed to the plurality of telescoping legs.

I In accordance with a further feature, there is further includes an external shelf member that is sized and shaped to fit over a bottom of the athletic receptacle, and which is attached to the plurality of telescoping legs, and moveable between a closed position against the athletic receptacle when the plurality of telescoping legs are in a collapsed state relative to the frame, and an open position away from the athletic receptacle when the plurality of telescopic legs are extended.

In accordance with a further feature, the external shelf member includes a plurality of vertical walls that surround a floor.

In accordance with a further feature, the floor of the external shelf member comprises a plurality of openings therethrough.

In accordance with a further feature, the floor of the external shelf member is formed of a fabric.

In accordance with a further feature, the floor of the external shelf member is a mesh.

In accordance with a further feature, plurality of rolling mechanisms are detachable casters.

In accordance with a further feature, the body includes at least one pocket on an external surface of the body.

In accordance with a further feature, the body include an extendable handle that extends from the body on a side opposite a side from which the plurality of telescoping legs extend.

In accordance with a further feature, the body is rectanguloid and is sized to comply with an airline carry on size requirement.

In accordance with some embodiments of the inventive disclosure, there is provided a portable tennis equipment bag that includes a generally rectanguloid body defining an internal space which has an access port on a first side of the body that is configured to be opened in a first state to allow access to the internal space and closed in a second state to retain a content in the internal space. The bag can further include a frame structure disposed inside the internal space, a plurality of extendible legs, where each one of the plurality of extendible legs is configured to recess into the frame structure inside the internal space in a closed position, and to extend therefrom in an extended position. The bag can further include an external shelf member that is operably coupled to a distal end of each one of the plurality of telescoping legs and which is positioned against the body when the plurality of telescoping legs are in the closed position.

In accordance with a further feature, the plurality of extendible legs are each telescoping, and having a plurality of nested leg segments.

In accordance with a further feature, the external shelf member comprises a floor and a plurality of vertical walls around the floor.

In accordance with a further feature, the floor of the external shelf member comprises a plurality of openings therethrough.

In accordance with a further feature, the floor of the external shelf member is formed of a fabric.

In accordance with a further feature, the floor of the external shelf member is a mesh.

In accordance with a further feature, the body includes at least one pocket on an external surface of the body.

In accordance with a further feature, the body includes at least one pocket on an external surface of the body.

In accordance with a further feature, the body include an extendable handle that extends from the body on a side opposite a side from which the plurality of telescoping legs extend.

In accordance with a further feature, the body is sized to comply with an airline carry on size requirement.

Although the invention is illustrated and described herein as embodied in a portable tennis equipment bag, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the terms "longitudinal" and "elongated" should be understood to mean in a direction corresponding to an elongated direction of the article being referenced or described. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
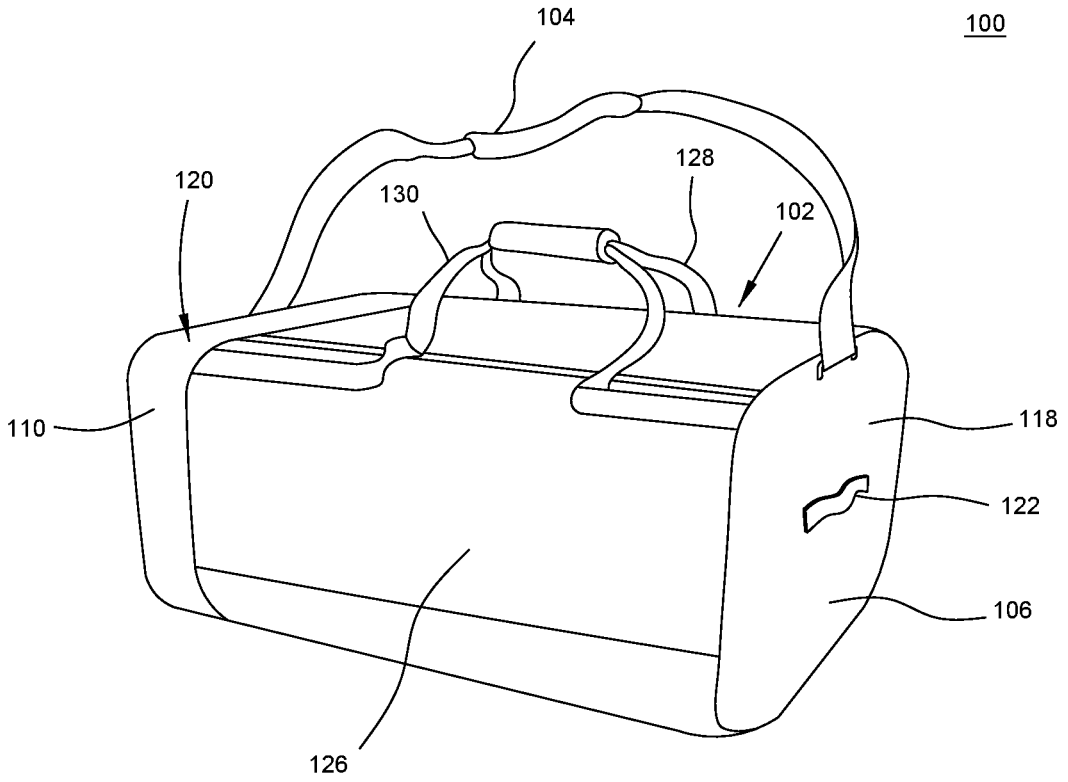
FIG. 1 is a perspective view of a portable tennis equipment bag in a carry position, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Various embodiments of portable tennis equipment bags are disclosed which allow a person to carry the portable tennis equipment bag in a closed carry position, to and from a tennis court, for example. When used at a tennis court or similar practice location, a set of extendable legs and a lower shelf portion can be lowered from a main body of the portable tennis equipment bag for use in storing and collecting tennis balls. The extendable legs can be telescoping, or folding, or any equivalent arrangement that allows the legs to extend from a closed position. The portable tennis equipment bag can be sized to fit within airline maximum baggage carry-on dimensions so the portable tennis equipment bag can be carried onto commercial transport aircraft. Although described here as a portable tennis equipment bag, those skilled in the art will appreciate that the disclosed structure can be used for other purposes, not just carrying tennis equipment. Accordingly, the disclosed embodiments should not be viewed as being limited to tennis related usage.

Figure 2:
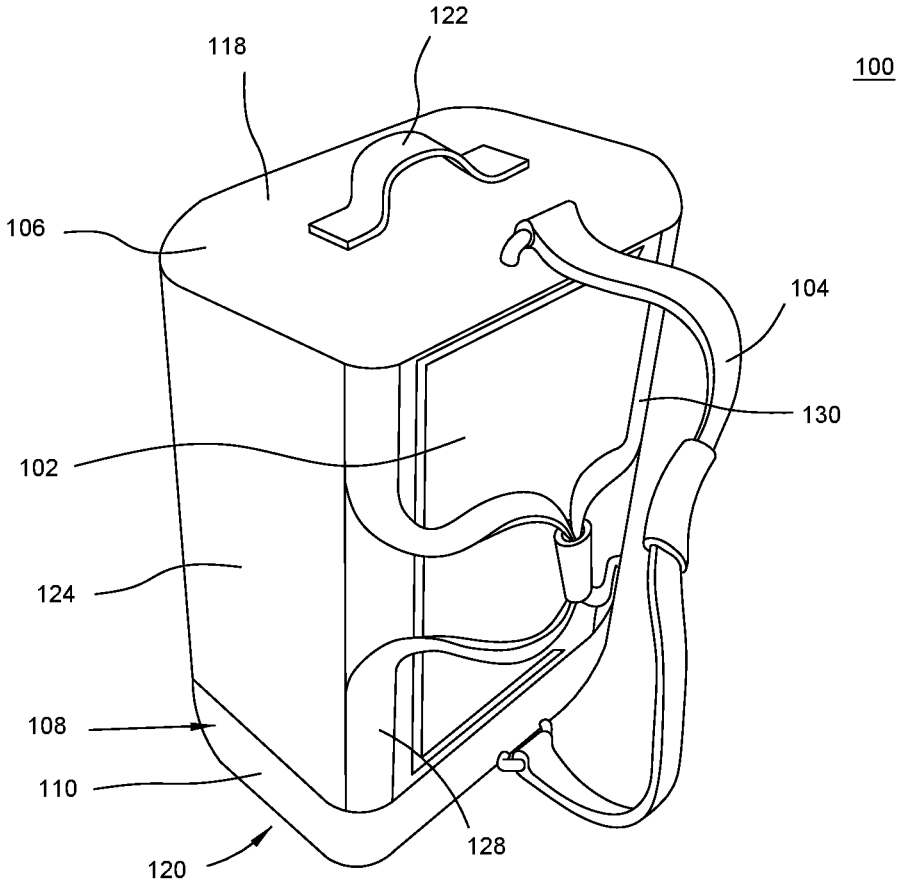
FIG. 2 is a side perspective view of a portable tennis equipment bag in a closed use position, in accordance with some embodiments.
Figure 3:
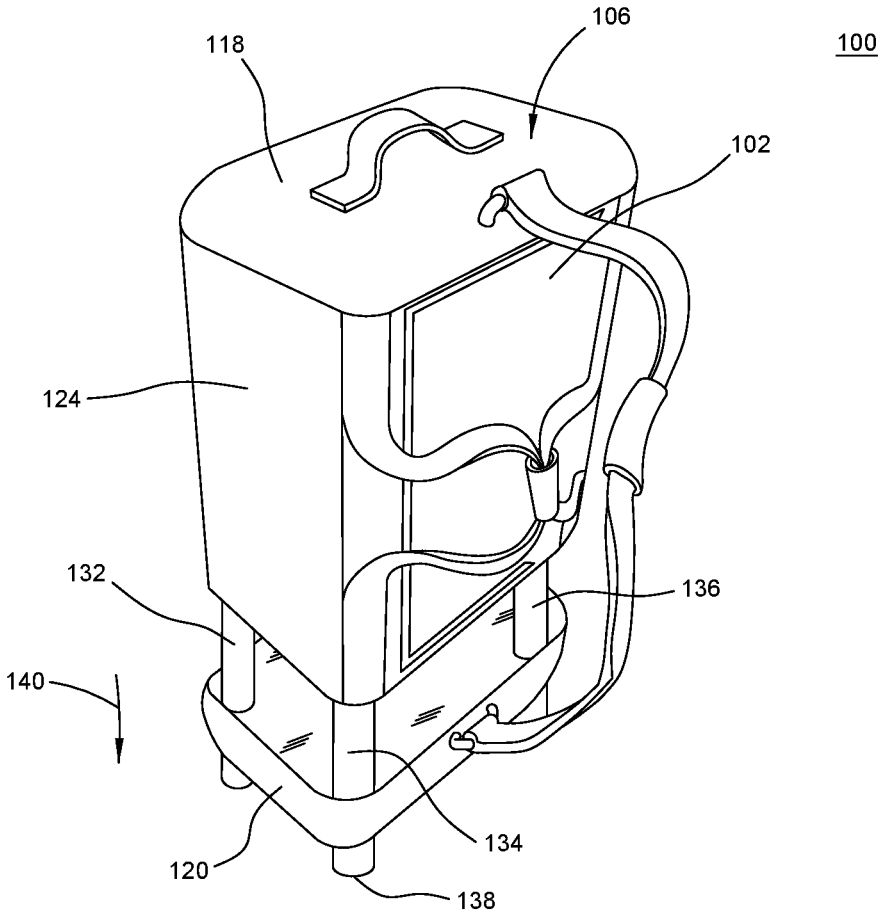
FIG. 3 is a side perspective view of a portable tennis equipment bag in an open use position, in accordance with some embodiments.
Figure 4:
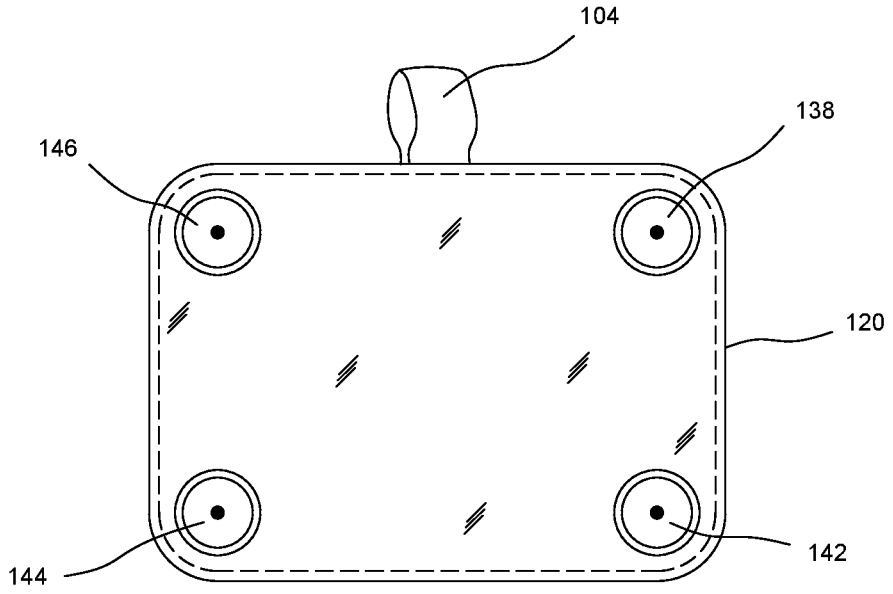
FIG. 4 is an end view of a portable tennis equipment bag, showing the bottoms of the extendable legs, in accordance with some embodiments.

FIG. 1 is a perspective view of a portable tennis equipment bag 100 in a carry position, in accordance with some embodiments. FIGS. 2 and 3 show other orientations and configurations of the bag 100. The bag 100 can be generally rectanguloid, having six major sides, such as, for example, a first major side or top 102, a major sides 124, 126, an end side 106 and an opposite end 110, among others, that are all generally perpendicular to the sides they are adjacent with. The first major side 102 can include a zippered access port or cover that allows a user to access the internal volume of the bag 100. The internal volume can be sized to accommodate certain athletic equipment, such as a tennis racquet, tennis balls, and other equipment, or other equipment. The sides can be made of a generally supple material, such as woven nylon or leather. The ends 106, 110 can be made of more rigid member 118, 120. In the carry position a shown a carry strap 104 can be used to carry the bag 100 by placing the carry strap 104 over a shoulder. Accordingly, a shoulder pad can be disposed on the carry strap 104, as is known. Handle straps 128, 130 are disposed on opposite elongated sides the top 102 can come together to form a handle to further assist in transport of the bag 100. A side strap 122 on end 106 allows the bag 100 to be lifted onto the opposite end 110, as shown in FIG. 2. End 110 includes a separate member 120, having rigid sides 108, that can detach from the bag 100. The member 120 is detachable from the bag, as shown in FIG. 3 and acts as a lower shelf to hold, for example, tennis balls. Extendible legs 132, 134, 136 (and one hidden from view) are housed inside a frame structure that is inside of the bag 100, and extend therefrom. The extendable legs 132, 134, 136 can be telescoping structures which, when extended, move the member 120 with them such that the lower shelf member 120 is close to the ground. A distal end 138 of the extendible legs 132, 134, 136 can extend past the lower shelf member 120 so that the lower shelf member is separated from the ground. However, when collapsed, the extendible legs 132, 134, 136 can collapse entirely within the bag 100, without the distal ends of the legs 132, 134, 136 sticking out of the bag 100. In the position of FIG. 3, The access port on side 102 can then be opened like a front door. Alternatively, end 106 can be provided with a zipper or similar closure so that end member 118 can be opened to allow access into the bag 100. FIG. 4 shows an end view of the bag 100 in which distal ends 138, 142, 144, 146 are seen, in either the open or closed positions. As used here, the terms "closed position" and "closed configuration" refer to the extendible legs being fully collapsed into the bag 100, and the lower shelf member being retained against an end or side of the bag. The terms "open position" and "open configuration" refer to a state where the extendible legs are extended, although not necessarily extended fully, with the lower shelf member being moved and spaced from the main body of the bag so that the lower shelf member can be used to hold tennis balls and/or other athletic gear.

Figure 5:
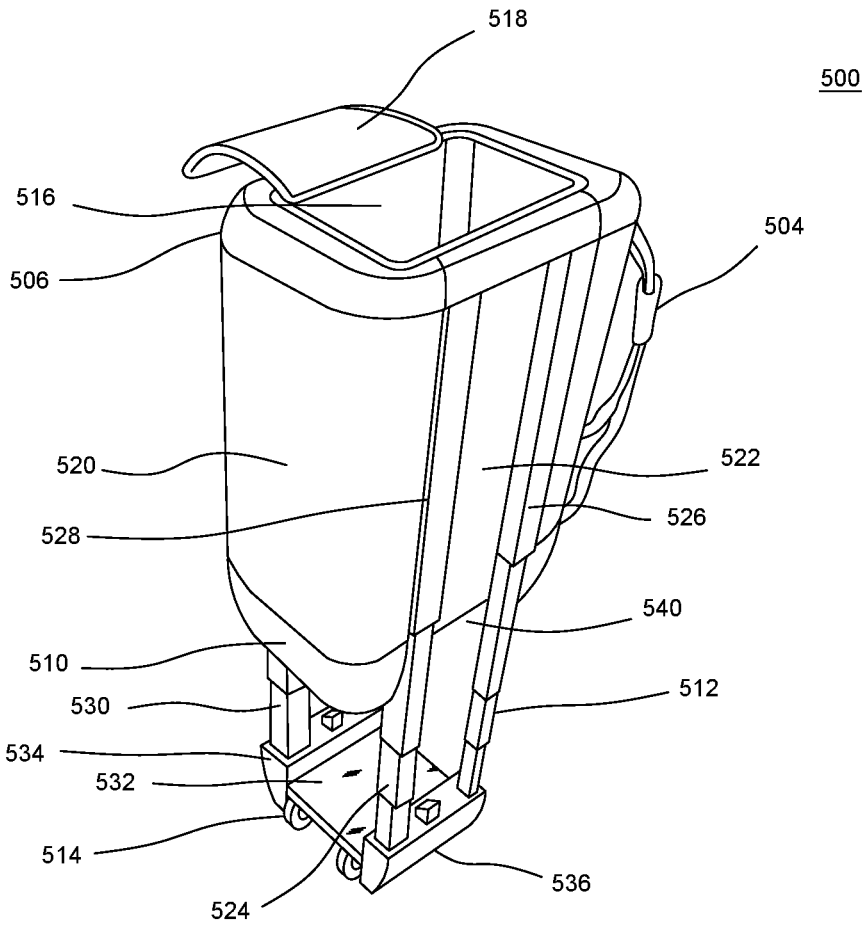
FIG. 5 is a perspective view of a portable tennis equipment bag in an open use position, in accordance with some embodiments.
Figure 6:
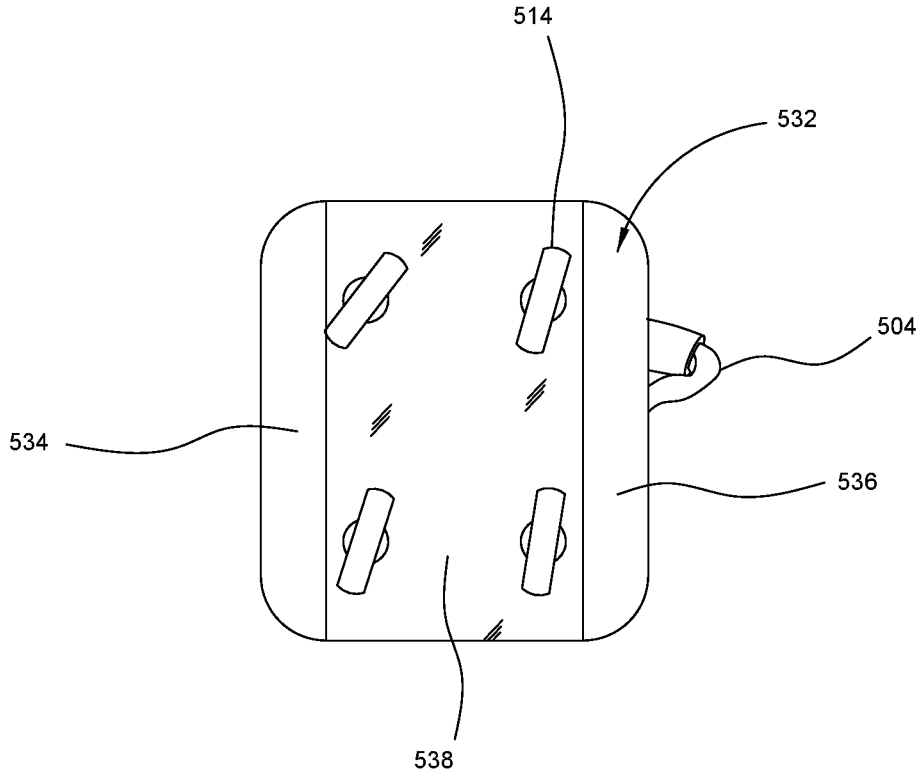
FIG. 6 is an end view of a portable tennis equipment bag, in accordance with some embodiments.

FIG. 5 is a perspective view of a portable tennis equipment bag 500 in an open use position, in accordance with some embodiments. That is, the bag 500 includes a plurality of extendible legs 512, 524, 530 that can extend from a frame structure that includes frame elements 526, 528 that are permanently fixed to the body of the bag 500 at a side 522. Two similar frame elements are located on the side opposite of side 522 for extendible leg 530 and an identical extendible leg that is hidden from view in this figure. The bag 500 can also include a carry strap 504 to allow the bag 500 to be carried on a person's shoulder (i.e. the carry strap 504 goes over the person's shoulder). At an end 506 of the bag 500 there can be a door or flap 518 that can be closed or opened (shown here open). When open, an internal volume or space 516 can be accessed, and things can be placed into, or taken out of the bag 500. The bag 500 can be generally rectanguloid, having six sides, including end 506, major sides 520, 522, and the other sides not in direct view in this figure. At a second end 510, which is opposite the first end 506 and forms the bottom of the internal space 516, a lower shelf member 532 can be stored in a closed position, with the extendible legs 512, 524, 530 collapsed into their respective frame elements 526, 528. In this embodiment a lower shelf portion 532 is attached to the distal ends of the extendible legs 512, 524, 530. The bottom or end view of the lower shelf portion 522 is shown in FIG. 6, in which the bottom side 538 of the shelf portion 532 is seen. Wheels or casters 514 are disposed on the bottom side 538, in a space defined between shelf side portions 534, 566, which extend down below the bottom side 538, but not below the bottoms of the wheels 514. Accordingly, the wheels allow a person to move the bag 500 around when in use. The lower shelf portion 532 is attached to the distal ends of each of the extendible legs 512, 524, 530, and thus moves with the lower or distal ends of the extendible legs 512, 524, 530. In a closed or in a carry position, the lower shelf portion 532 would be brought into contact with the external side of end 510, and can fit within a recess 540 at the end 510. The extendible legs 512, 524, 530 can be telescoping structures that can be extended to various lengths between fully collapsed and fully extended, and held in those positions by spring plungers that extend through holes in the relative outer leg portion or frame structure 526, 528 in which they are nested, is well known.

Figure 7:
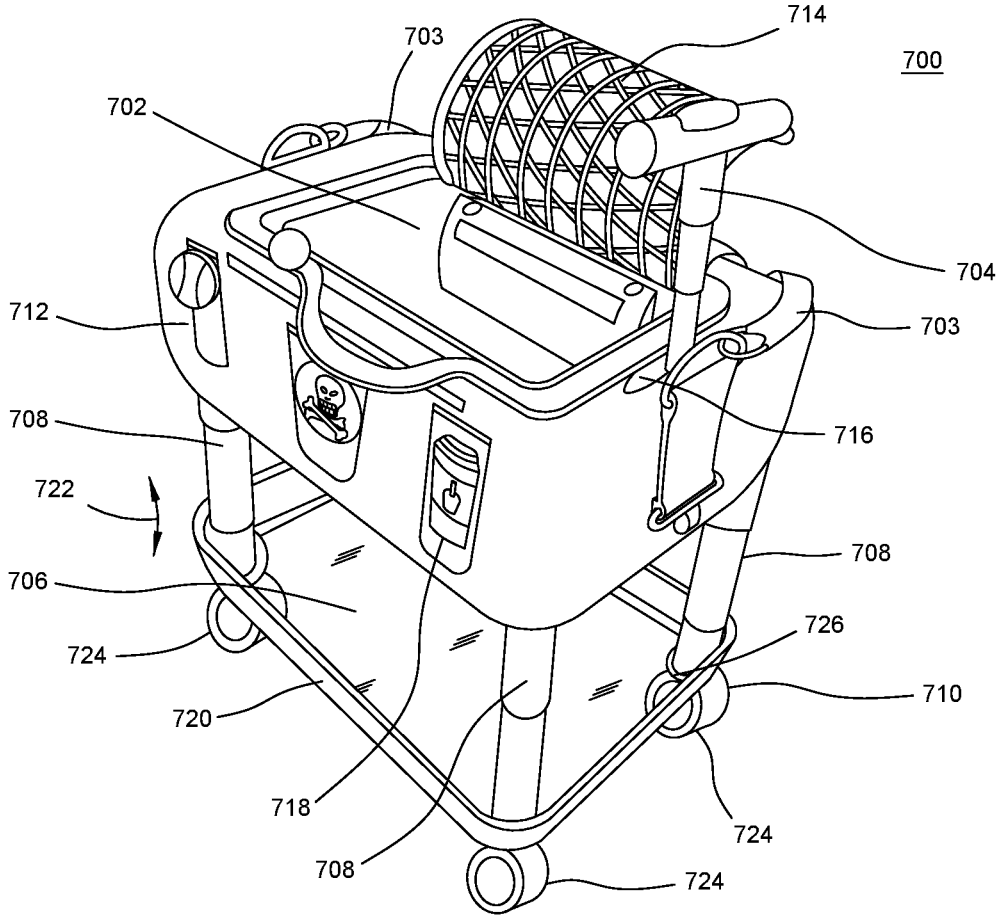
FIG. 7 is a perspective view of a portable tennis equipment bag in an open use configuration, in accordance with some embodiments.

FIG. 7 is a perspective view of a portable tennis equipment bag 700 in an open use configuration, in accordance with some embodiments. Again, the bag 700 has a generally rectanguloid body having an internal volume 702 that is bounded by the walls of the body. A collapsible handle 704 can be collapsed into a side pocket 716 when not in use, and when extended as shown allows a person to push the bag 700 around. The handle 704 extends vertically, when the bag 700 is in the use orientation as shown. A carry strap 403 allows a user to carry the bag when it is closed into a carry configuration. A cover 714 at a top can be opened to allow access to an internal space that is bounded by the walls 712, bottom, and top of the bag 700. The body of the bag 700 houses structure in which extendible legs 708 are attached and into which the several portions of the each extendible leg 708 are housed when each extendible leg 708 is fully collapsed. The legs 708 are attached that their distal ends 726 to a lower shelf member 720. The lower shelf member is sized to mate with a bottom of the body of the bag 700 when the legs 708 are fully collapsed. That is, from the outside, the lower shelf member 720 will appear to simply be a rigid bottom portion of the bag 700 when the legs 708 are fully collapsed into the internal frame structure of the bag 700. The legs 708 can be moved between a fully collapsed state and a fully extended state, as indicated by arrow 722. Wheels or casters 724 can be coupled to the lower shelf portion at an outside or lowermost surface, or can be coupled to the legs 708 through the lower shelf portion 720. The wheels 724 can be stored in the bag 700 when the legs 708 are collapsed. An interior surface 706 of the lower shelf portion 720 can be used for holding balls or other equipment when the legs are extended, and can be a mesh or woven material in some embodiment to help reduce the weight of the bag 700. There can be pockets 718 provided on the outside of the body of the bag 700 that can be sized to hold various objects, such as, for example, a drink bottle, keys, or other such items.

Figure 8:
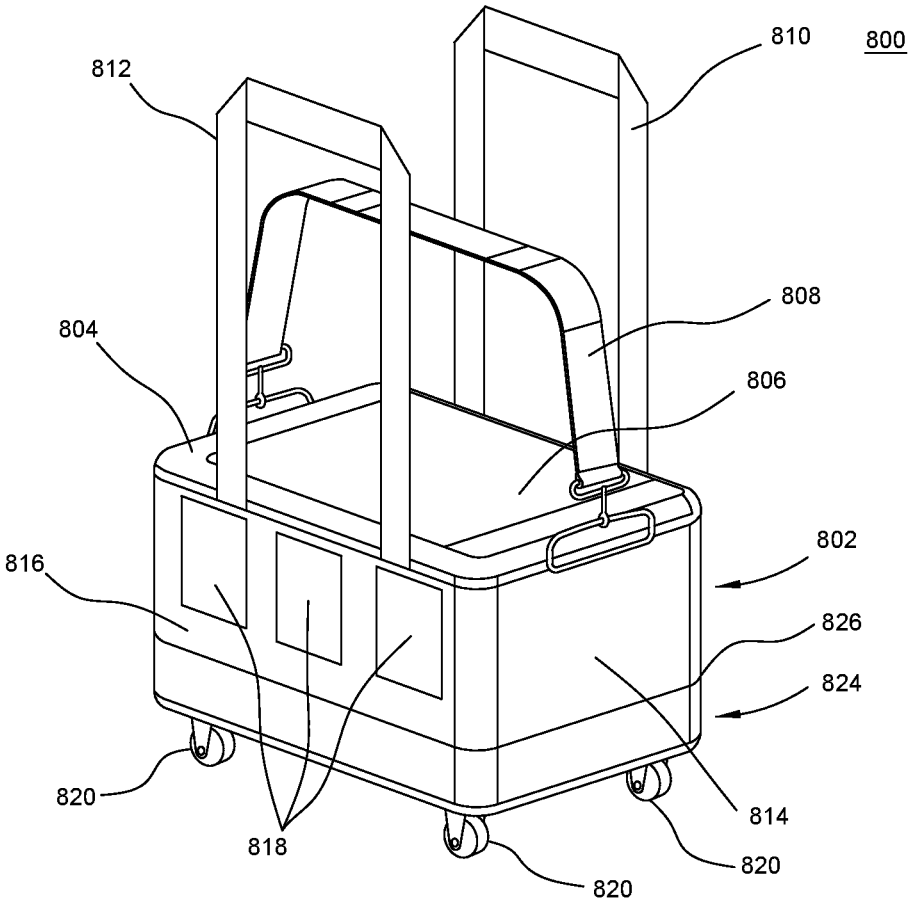
FIG. 8 is a perspective view of a portable tennis equipment bag in a closed or carry configuration, in accordance with some embodiments.
Figure 9:
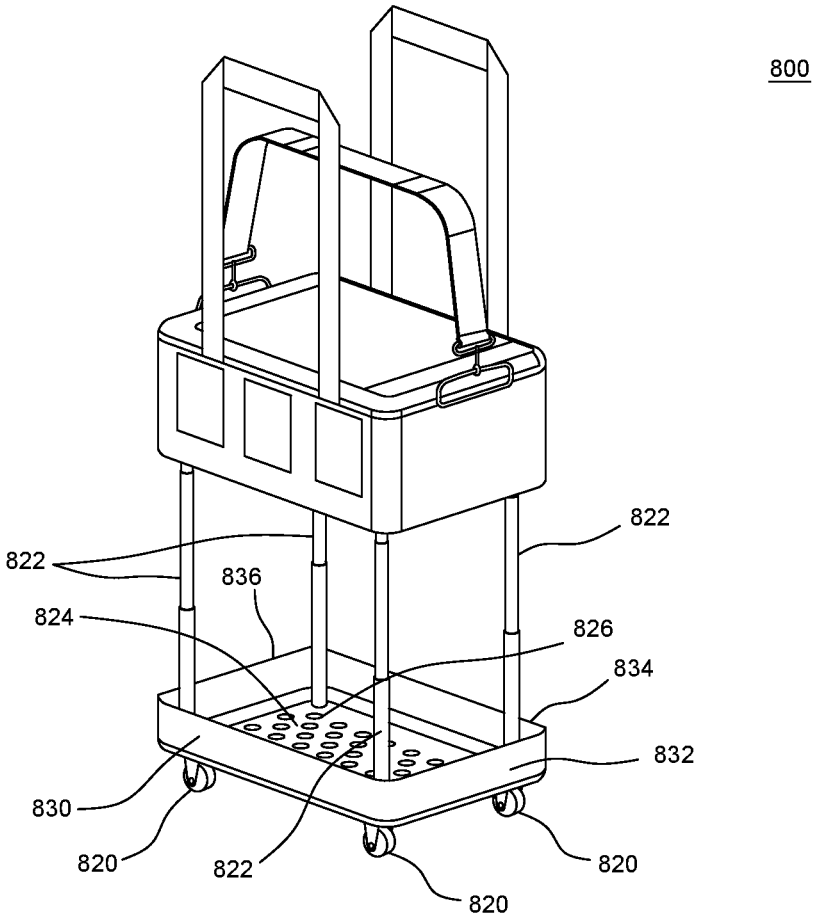
FIG. 9 is a perspective view of a portable tennis equipment bag in an open use configuration, in accordance with some embodiments.

FIGS. 8 and 9 show perspective views of a portable tennis equipment bag 800 in a closed or carry configuration, and in an open use configuration, respectively, in accordance with some embodiments. The bag 800 is similar to bag 700, and includes a rectanguloid body 802 comprised of six generally planar walls including side walls 814, 816, and a top 804 that can have a door or flap 806 that can be closed or opened, such as by a zipper around a perimeter of the flap/door 806. The bag 800 can include a carry strap 808 that is coupled to opposite ends of the bag 800 generally at the center of the opposing ends, The carry strap 808 can be removable, such as by clips at each end of the carry strap 808 that can be coupled to D rings located at the opposite ends of the bag 800. In addition to the carry strap 808, there can be handle straps 810, 812 provided on opposing sides. The handle straps 810, 812 are each attached at two separate points on their respective sides, with one end of the strap 810, 812 being near end 814 and the other end of the straps 810, 812 being near the opposite end of the bag 800, with each handle strap 810, 812, therefore forming an inverted "U" shape. The centers of the handle straps 810, 812 can be brought together so that they can be jointly grasped, or they can be each grasped individually, such as where each handle strap is grasped by a different person on opposite sides of the bag 800. One or more pockets 818 can be provided on the a side 816 of the bag 800, and the pockets 818 can be closeable or open.

In FIG. 8 the lower shelf portion 804 is shown against the body of the bag 800, in a closed configuration, concealing extendable legs 822, which can be seen in FIG. 9 where the lower shelf portion 804 is separated from the body of the bag 800. The lower shelf portion 804 is coupled to the extendible legs 822 at a lower or distal end 826 of each of the legs 822. Detachable wheels 820 can be attached under the lower shelf portion 804 at the locations where the legs 822 meet the lower shelf portion 804. The lower shelf portion 804 is formed by 4 vertical wall sections 830, 832, 834, 836 which help retain tennis balls or other equipment placed on a floor 824 that spans the bottom of the lower shelf portion 804 between the walls 830-836. The floor 824 can be a solid rigid planar portion, or it can have openings therethrough for weight reduction, or it can be a fabric or mesh in some embodiments.

Figure 10:
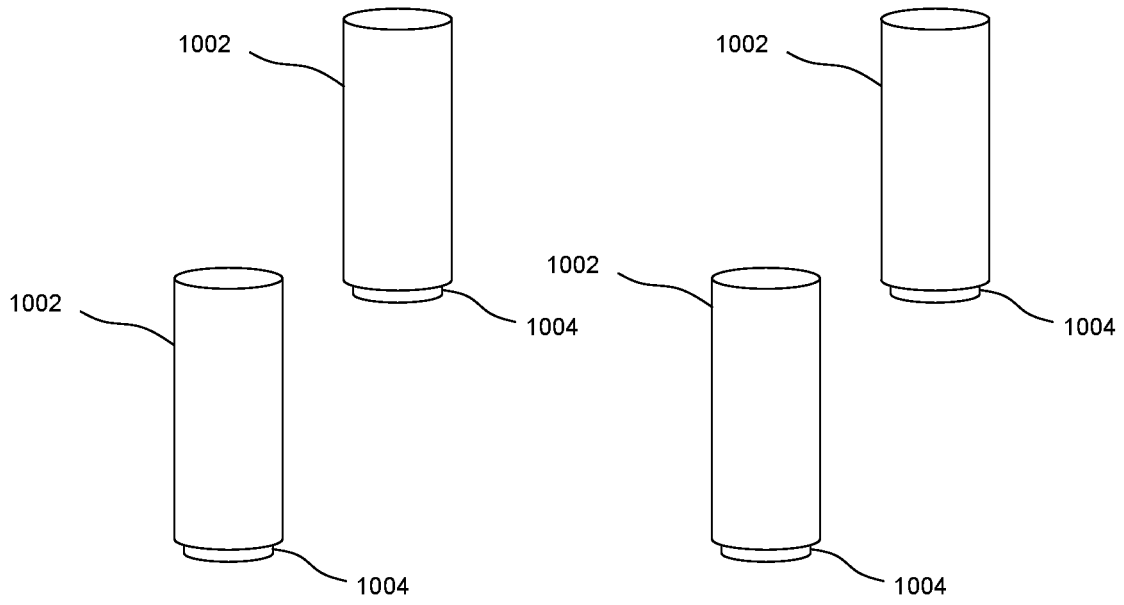
FIG. 10 shows an arrangement of portions of an internal frame structure for a portable tennis equipment bag in which extendable legs are housed, in accordance with some embodiments.
Figure 11:
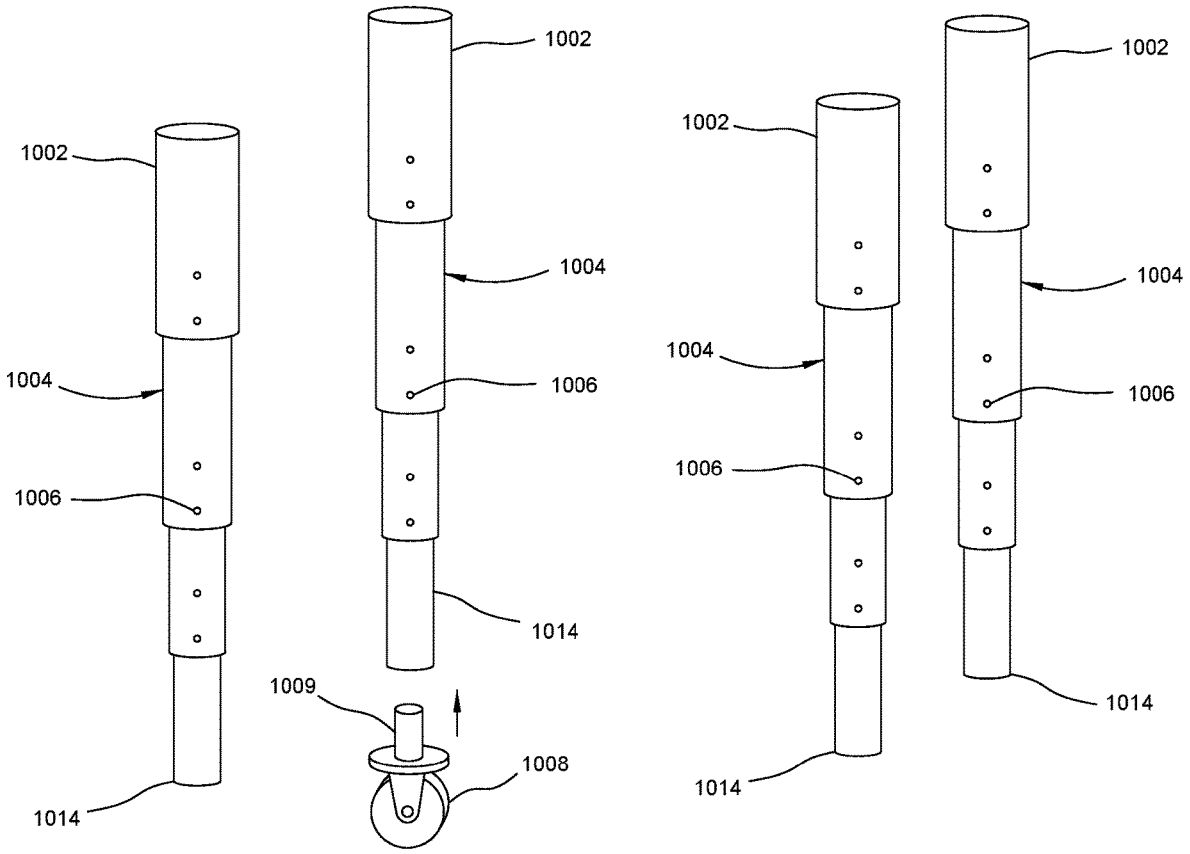
FIG. 11 shows an arrangement of portions of an internal frame structure for a portable tennis equipment bag in which extendable legs are housed, with the extendable legs installed, in accordance with some embodiments.
Figure 12:
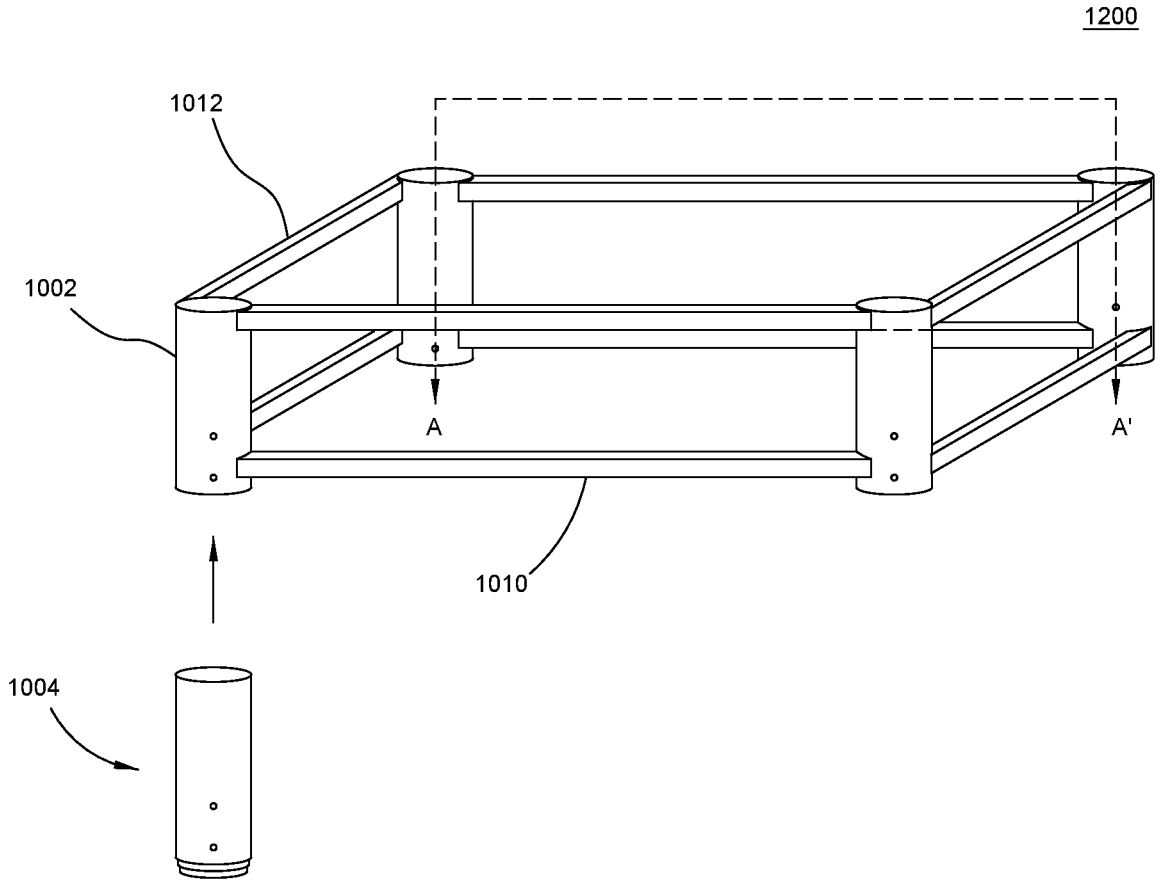
FIG. 12 shows one exemplary frame structure for a portable tennis equipment bag, in accordance with some embodiments.

FIG. 10 shows an arrangement of leg housings 1002 of an internal frame structure for a portable tennis equipment bag in which extendable legs are housed, in accordance with some embodiments. The leg housings 1002 are each cylindrical, as shown here, but can alternatively be square or triangular tube. In each leg housing 1002 is an extendable leg 1004 in a collapsed state, where each of several interlocking segments of each of the legs 1004 are collapsed into the leg housings 1002. Each of the leg housings 1002 are disposed within, or on the outside, of a portable tennis equipment bag, such as bags 100, 500, 700, and 800. The leg housings 1002 can be coupled to each other by struts or beams that act as a skeleton in the bag and serve to hold the generally rectangular shape of the bag. Four leg housing 1002 are shown here to indicate that each leg housing 1002 can be located, for example in a different corner of the bag. In FIG. 11 the legs 1004 are shown extended from the collapsed position in FIG. 10. The legs 1004 can be formed of several nested or telescoping leg portions or segments. The amount of extension of each leg portion can be selected by a sprung plunger 1006 in each section that can lock into one of several holes in the segment into which it is nested. A detachable wheel 1008 can have a vertical shaft 1009 that can be inserted in the distal end 1014 of the lowermost leg portion. The wheels 1008 can be removed and stored in the bag when the bag is being carried for transport. FIG. 12 shows one exemplary frame structure 1200 for a portable tennis equipment bag, in accordance with some embodiments. In this exemplary arrangement, the leg housings 1002 are each interconnected with their adjacent corners by lower and upper struts 1010, 1012. While cylindrical legs can be used, square tube sections ensure alignment of the plunger 1006 with holes to allow easier selection of the amount of extension. The struts 1010, 1012 maintain a separation between the portions and help maintain the rectanguloid form of the bag. The structure 1200 can be molded, and then installed into a bag body with the extendible legs installed or otherwise mounted in leg housings 1002. To mount an extendible leg 1004 in a leg housing 1002 the outermost segment of the leg 1004 can be affixed to the housing, such as by glue, or fasteners such as screws or bolts.

Figure 13:
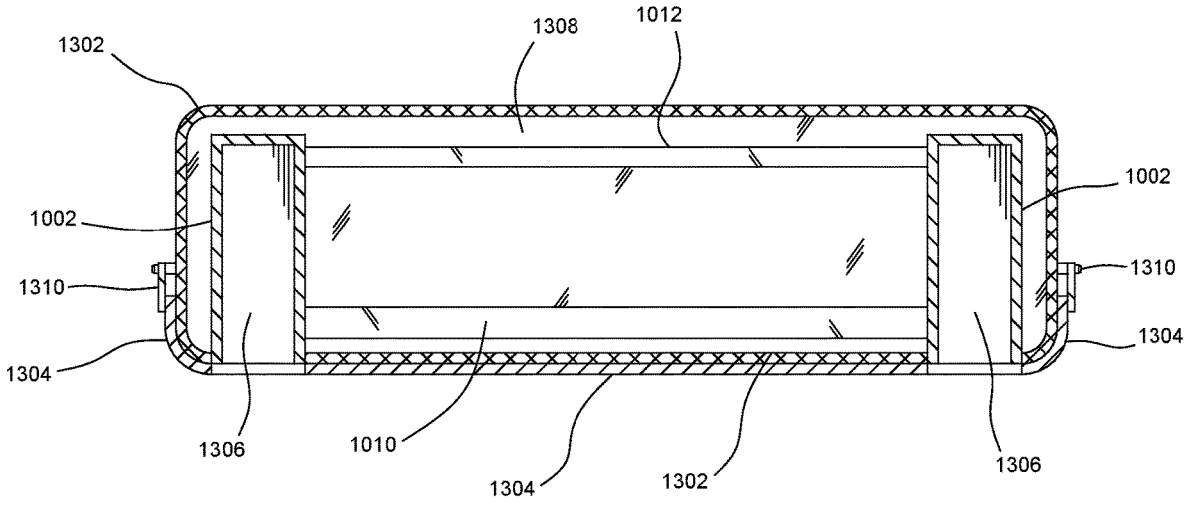
FIG. 13 shows a cut-away view of a portable tennis equipment bag showing portions of the frame structure in which extendable legs are housed, in accordance with some embodiments.

FIG. 13 shows a cut-away view of a portable tennis equipment bag taken along plane A-A' in FIG. 12. The leg housings 1002 of the frame structure 1200 in which extendable legs 1004 are housed, are shown in the body 1302 of a portable tennis equipment bag. Struts 1010, 1012 are shown connecting the leg housing 1002, which have a space 1306 in which the legs are mounted. The leg housings 1002 are open at the bottom and align with similar openings in the body 1302 of the bag. The body 1302 of the bag defines a space 1308 in which gear and equipment can be stored. A lower shelf portion 1304 is shown at the bottom of the bag 1302. The bottom or distal ends of each of the legs can be attached to the lower shelf portion 1304, or a short section of the legs can extend through the bottom of the lower shelf portion 1304.

Figure 14:
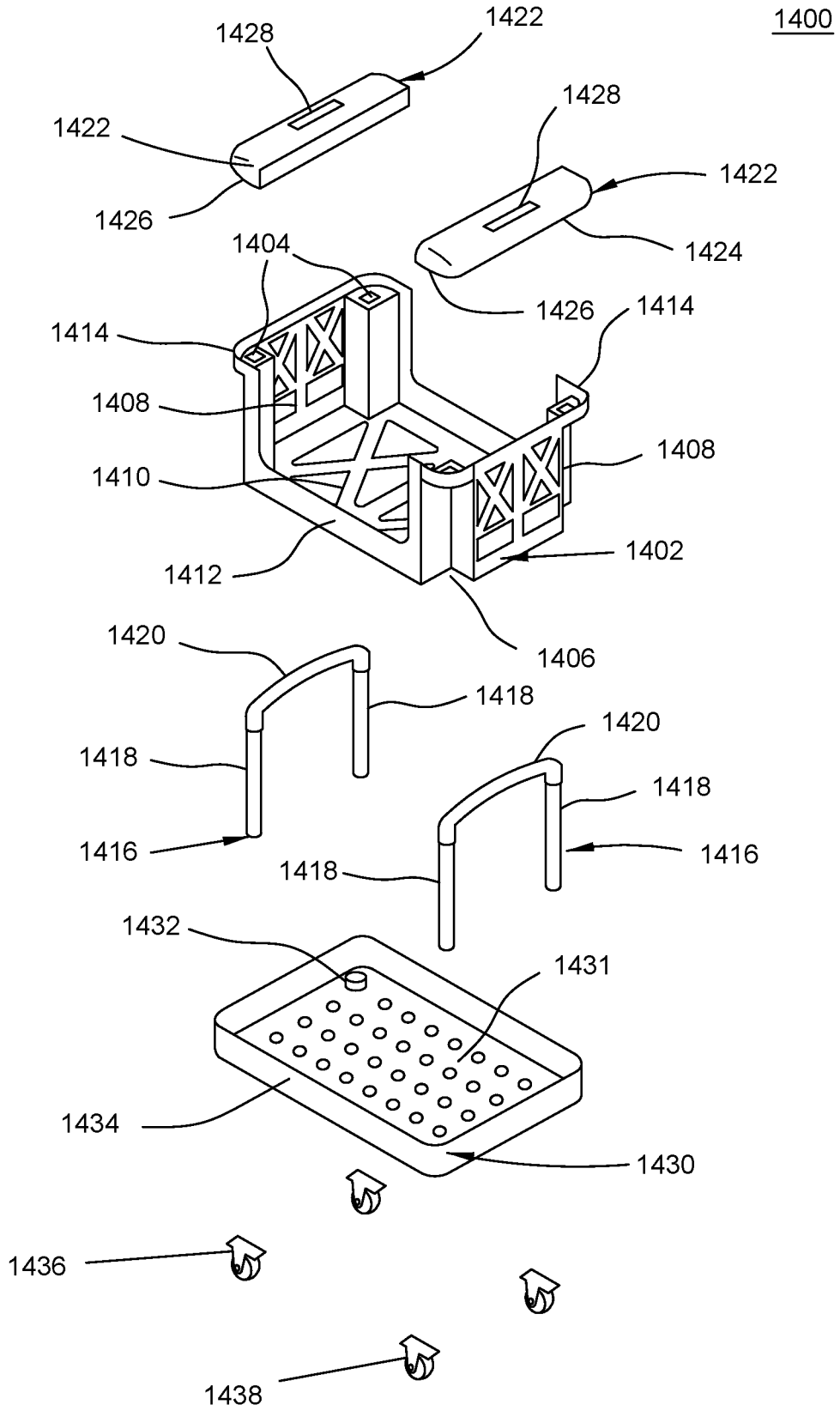
FIG. 14 shows an exploded view of an internal frame structure for a portable tennis equipment bag, in accordance with some embodiments.

FIG. 14 shows an exploded view of an internal frame structure 1400 for a portable tennis equipment bag, in accordance with some embodiments. A frame 1402 is configured to fit inside a generally rectanguloid bag body (i.e. 802) and provides a rigid structure that supports the fabric of the bag, and further supports the extendible legs and allows the extendible legs to be collapsed inside the bag body. The frame includes end sides 1408 at opposite ends that sit adjacent and against the end walls of the bag body. The corner portions 1406 of the end sides are inverted inward to create a vertical channel that is on the outside of the frame 1402 and between the frame 1402 and the body of the bag. At the top of the corner portions 1406 there are openings

1404 to allow the vertical portions of extendible leg assemblies 1416 to pass through. The extendible leg assemblies 1416 each have a pair of extendible legs 1418 that are joined at their top portions by a brace section 1420 which is rigid and holds the two extendible legs 1418 parallel. In assembly, the extendible leg assemblies 1416 are positioned over the frame 1402 at each end 1408, and the extensible leg assemblies 1416 are lowered such that the extendible legs 1418 pass through the openings 1404, and along the vertical channels 1406 at each corner of the frame 1402. The tops of the corner portions, where the openings 1404 are located, fully encircle the tops of the extendible legs 1418 upon the extendible leg assemblies 1416 being placed into the frame 1402. The bottoms of the extendible legs 1418 pass through openings in the body of the bag and attach to the lower shelf portion 1430 at the corners 1432 of the lower shelf portion 1430. To hold the extendible leg assemblies 1416 in place in the frame 1402, a cover 1422 is provided that mates with the upper portion 1414 of the end sides 1408 of the frame 1402, and can have latching features 1424, 1426 that snap into reliefs provided in the upper portion 1414. Thus, the covers 1422 prevent the brace section 1420 of the extendible leg assemblies 1416 from rising up, relative to the frame 1402. The frame 1402 has a bottom or floor 1410 and main side walls 1412 between the two end sides 1408 that provides the rigidity of the frame 1402.

The lower shelf potion 1430 has a horizontal floor 1431 that is surrounded by a vertical wall 1434 around the floor 1431. As mentioned, the lower or distal ends of each of the extendible legs 1418 can be attached to the corners of the floor 1431. The vertical wall 1434 is sized to substantially mate with the bottom of the bag body. That is, the vertical wall 1434 has four sides that align with corresponding sides of the bag body at the bottom of the bag body. Various casters can be further attached to the bottoms of the extendible legs 1418 at the corners 1432 of the lower shelf portion 1430. For example, non-steerable casters 1436 can be attached on one side of the lower shelf portion 1403, and steerable casters can be positioned at the opposite side. Steerable casters can rotate about a vertical support axis, and non-steerable casters simply hold their orientation and do not rotate. As a result, the portable tennis equipment bag using the frame structure 1400 can be steered by a user on a tennis court or other surface, as opposed to if all of the casters were steerable, which allows the bag to be pushed in any direction at any time, which can assist in preventing the bag from rolling on its own (e.g. if there is sufficient wind to push the bag).

The disclosed portable tennis equipment bag allows a person to easily carry and transport tennis equipment including one or more racquets and tennis balls. The disclosed bag includes a plurality of extendible legs that are connected to a shelf portion. The legs can extend from the body of the bag, and lock into a desired height position. The external shelf portion can be positioned against a side of the body of the bag, such as a bottom of the bag, and then separated away from the body of the bag by extending the legs. Wheels can be attached to the bottom of the legs, or to the bottom of the external shelf portion in order to allow the bag to be moved about when used in an open configuration. The bag can be sized so as to meet the carry on dimensional requirement of major airlines.

What is claimed is:

1. An athletic receptacle comprising:

a body having a plurality of walls which define an interior space;

a frame disposed in the interior space;

a plurality of telescoping legs configured to be affixed to the frame;

a plurality of rolling mechanisms configured to be affixed to the plurality of telescoping legs; and an external shelf member that is sized and shaped to fit over a bottom of the athletic receptacle, and which is attached to the plurality of telescoping legs, and moveable between a closed position against the athletic receptacle when the plurality of telescoping legs are in a collapsed state relative to the frame, and an open position away from the athletic receptacle when the plurality of telescopic legs are extended.

2. The athletic receptacle of claim 1, wherein the external shelf member includes a plurality of vertical walls that surround a floor.

3. The athletic receptacle of claim 2, wherein the floor of the external shelf member comprises a plurality of openings therethrough.

4. The athletic receptacle of claim 2 wherein the floor of the external shelf member is formed of a fabric.

5. The athletic receptacle of claim 2, wherein the floor of the external shelf member is a mesh.

6. The athletic receptacle of claim 1, wherein plurality of rolling mechanisms are detachable casters.

7. The athletic receptacle of claim 1 wherein the body includes at least one pocket on an external surface of the body.

8. The athletic receptacle of claim 1, wherein the body include an extendable handle that extends from the body on a side opposite a side from which the plurality of telescoping legs extend.

9. The athletic receptacle of claim 1 wherein the body is rectanguloid and is sized to comply with an airline carry on size requirement.

10. A portable tennis equipment bag, comprising:

a generally rectanguloid body defining an internal space, and having an access port on a first side of the body that is configured to be opened in a first state to allow access to the internal space and closed in a second state to retain a content in the internal space;

a frame structure disposed inside the internal space;

a plurality of extendible legs, each one of the plurality of extendible legs configured to recess into the frame structure inside the internal space in a closed position and to extend therefrom in an extended position; and an external shelf member that is operably coupled to a distal end of each one of the plurality of telescoping legs and which is positioned against the body when the plurality of telescoping legs are in the closed position, wherein the external shelf member comprises a floor and a plurality of vertical walls around the floor.

11. The portable tennis equipment bag of claim 10, wherein the plurality of extendible legs are each telescoping, and having a plurality of nested leg segments.

12. The portable tennis equipment bag of claim 10, wherein the floor of the external shelf member comprises a plurality of openings therethrough.

13. The portable tennis equipment bag of claim 10, wherein the floor of the external shelf member is formed of a fabric.

14. The portable tennis equipment bag of claim 10, wherein the floor of the external shelf member is a mesh.

15. The portable tennis equipment bag of claim 10, wherein the body includes at least one pocket on an external surface of the body.

16. The portable tennis equipment bag of claim 10, wherein the body include an extendable handle that extends from the body on a side opposite a side from which the plurality of telescoping legs extend.

17. The portable tennis equipment bag of claim 10 wherein the body is sized to comply with an airline carry on size requirement.

* * * * *